US012473902B2

(12) United States Patent
Chou et al.

(10) Patent No.: US 12,473,902 B2
(45) Date of Patent: Nov. 18, 2025

(54) AIR COMPRESSOR STRUCTURE

(71) Applicant: UNIK WORLD INDUSTRIAL CO., LTD., Tainan (TW)

(72) Inventors: Wen San Chou, Tainan (TW); Cheng Hsien Chou, Tainan (TW)

(73) Assignee: UNIK WORLD INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 18/674,914

(22) Filed: May 26, 2024

(65) Prior Publication Data

US 2025/0237208 A1 Jul. 24, 2025

Related U.S. Application Data

(60) Provisional application No. 63/624,772, filed on Jan. 24, 2024.

(30) Foreign Application Priority Data

May 8, 2024 (TW) ..... 113117059

(51) Int. Cl.
*F04B 39/12* (2006.01)
*F04B 35/04* (2006.01)

(52) U.S. Cl.
CPC ..... *F04B 39/125* (2013.01); *F04B 35/04* (2013.01)

(58) Field of Classification Search
None
See application file for complete search history.

(56) References Cited

U.S. PATENT DOCUMENTS

2007/0098583 A1* 5/2007 Chou ..... F04B 35/01 417/571

FOREIGN PATENT DOCUMENTS

| | | |
|---|---|---|
| CN | 202628461 | 12/2012 |
| JP | 2012251502 | 12/2012 |
| TW | 360336 | 6/1999 |
| TW | M597821 | 7/2020 |
| TW | M597821 U * | 7/2020 |
| TW | M661541 | 10/2024 |

OTHER PUBLICATIONS

English Translation TW-M597821-U (Year: 2020).*
"Office Action of Taiwan Counterpart Application", issued on Feb. 8, 2025, p. 1-p. 7.
"Notice of Reasons for Refusal of Japan Counterpart Application", issued on Jun. 20, 2025, p. 1-p. 4.

* cited by examiner

*Primary Examiner* — Shafiq Mian
(74) *Attorney, Agent, or Firm* — JCIPRNET

(57) ABSTRACT

An air compressor structure, including a cylinder, a piston, and a cylinder head, is provided. The piston is coupled to the cylinder and performs a reciprocating motion to generate compressed air. The cylinder head is detachably assembled to the cylinder. The cylinder head has an air storage chamber and an air outlet. The air storage chamber is communicated between the cylinder and the air outlet to receive the compressed air and discharge the compressed air from the air compressor structure through the air outlet.

7 Claims, 5 Drawing Sheets

AIR COMPRESSOR STRUCTURE

CROSS-REFERENCE TO RELATED APPLICATION

This application claims the priority benefit of U.S. provisional application Ser. No. 63/624,772, filed on Jan. 24, 2024, and Taiwan application serial no. 113117059, filed on May 8, 2024. The entirety of each of the above-mentioned patent applications is hereby incorporated by reference herein and made a part of this specification.

BACKGROUND

Technical Field

This disclosure relates to an air compressor structure.

Description of Related Art

The main structure of an air compressor is to use a motor to drive a piston to perform a reciprocating compression action in a cylinder. The compressed air may be filled into an item to be inflated connected thereto accordingly.

As known by the general public, during a process of a gas being compressed, the temperature often rises. At the same time, in the structure of the air compressor mentioned above, the intermittency caused by a reciprocating motion of the piston also causes instability in air pressure transmission, and as the intermittent pressure shock waves cause the pressure gauge pointer to jitter, there may be a difference generated between the air pressure value displayed by the pressure gauge and the actual air pressure value at the exit end.

Accordingly, providing a simple structure while taking into account the above requirements is actually a topic that relevant technical personnel need to consider and solve.

SUMMARY

This disclosure provides an air compressor structure that provides compactness in structure and also takes into account both structural sealing and air pressure stability.

An air compressor structure of this disclosure includes a cylinder, a piston, and a cylinder head. The piston is coupled to the cylinder and performs a reciprocating motion to generate compressed air. The cylinder head is detachably assembled to the cylinder. The cylinder head has an air storage chamber and an air outlet. The air storage chamber is communicated between the cylinder and the air outlet to receive the compressed air and discharge the compressed air from the air compressor structure through the air outlet.

In summary, in the air compressor structure of the embodiments of this disclosure, the cylinder head is provided with the air storage chamber and the air outlet to receive the compressed air from the cylinder and enable the compressed air to be discharged from the air outlet through a rear of the air storage chamber. In this way, the cylinder head is presented as an integrated structure, which not only engages with and covers the cylinder to receive the compressed air, but also uses the air storage chamber inside as a buffer zone for the compressed air, taking into account both structural sealing and air pressure stability.

DESCRIPTION OF THE EMBODIMENTS

Figure 1:
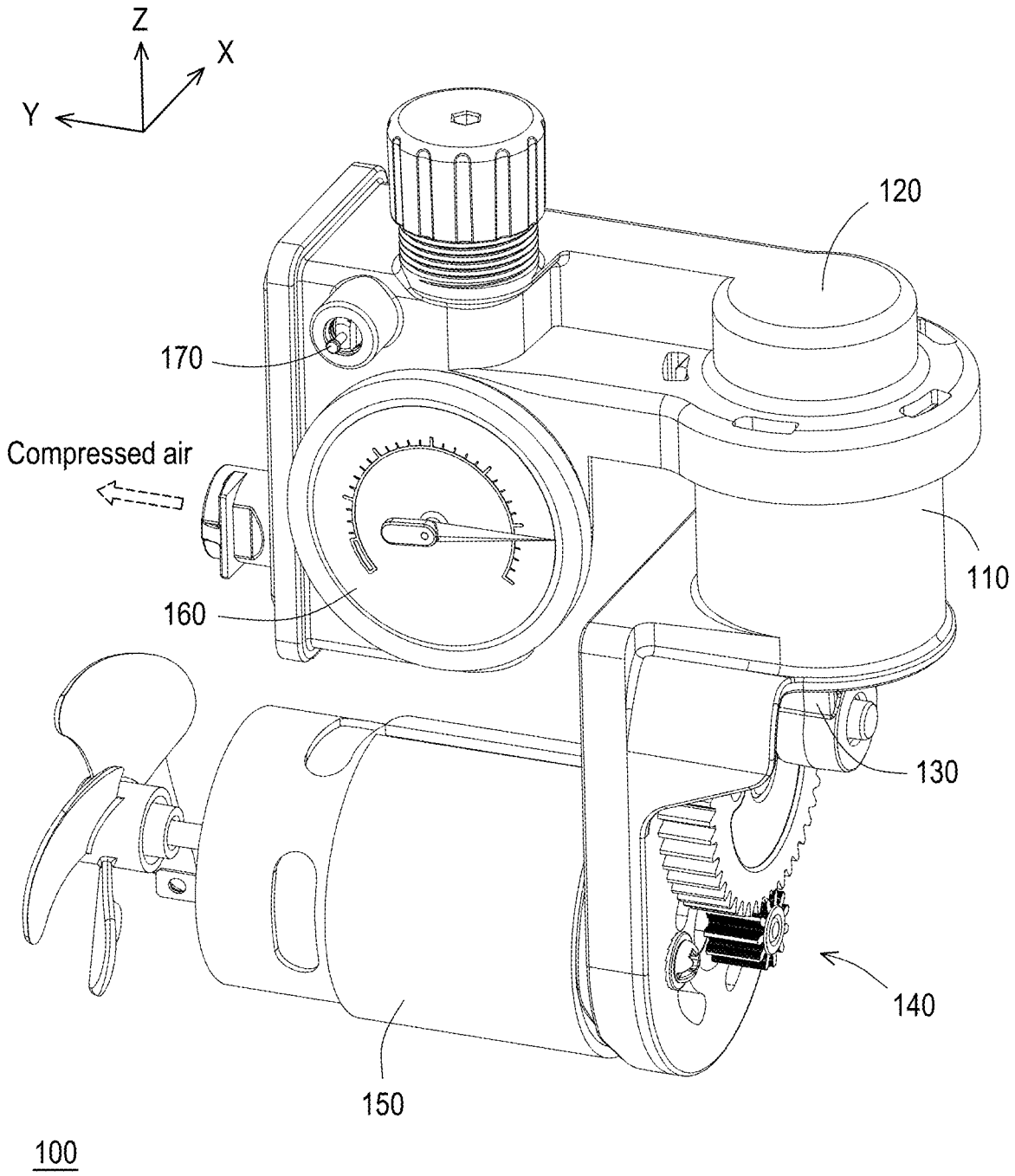
FIG. 1 is a schematic diagram of an air compressor structure according to an embodiment of this disclosure.
Figure 2:
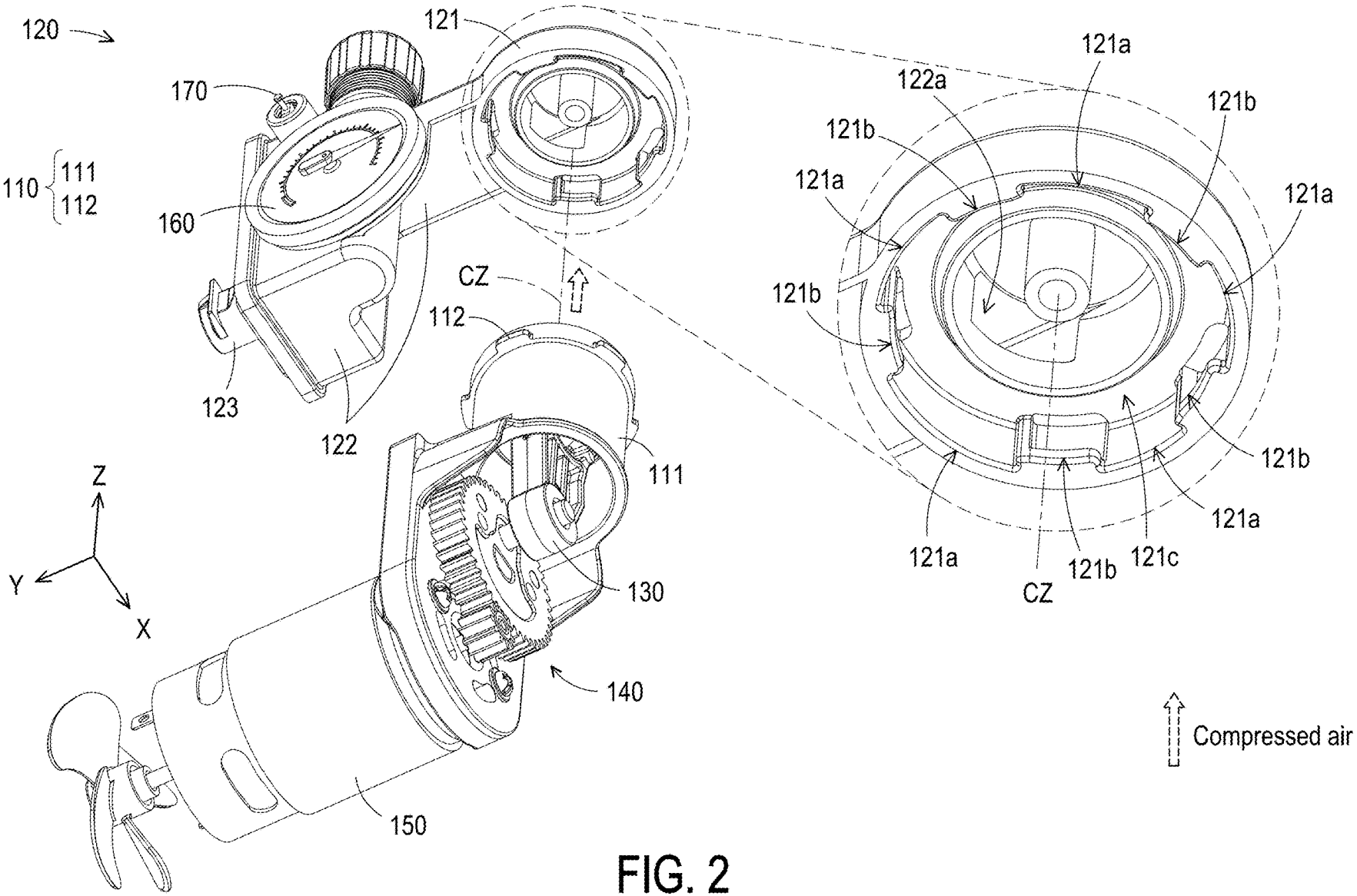
FIG. 2 is an exploded schematic diagram of part of components of the air compressor structure in FIG. 1.

FIG. 1 is a schematic diagram of an air compressor structure according to an embodiment of this disclosure. FIG. 2 is an exploded schematic diagram of part of components of the air compressor structure in FIG. 1. Cartesian coordinates X-Y-Z are also provided here to facilitate descriptions of the components. Please refer to FIG. 1 and FIG. 2 at the same time. In this embodiment, an air compressor structure 100 includes a cylinder 110, a cylinder head 120, a piston 130, a transmission mechanism 140, a motor 150, a pressure gauge 160, and a pressure relief valve 170. The cylinder head 120 is detachably assembled to the cylinder 110. The transmission mechanism 140 is connected between the motor 150 and a bottom end of the piston 130, and a top end of the piston 130 is movably coupled into the cylinder 110, so that the motor 150 may drive the piston 130 to perform a reciprocating motion in the cylinder 110 through the transmission mechanism 140 to generate compressed air, wherein the top end of the piston 130 moves closer to or away from the cylinder head 120 along with the reciprocating motion. When the piston 130 proceeds to compress air, the top end of the piston 130 also moves toward the cylinder head 120 and squeezes the compressed air from the cylinder 110 toward the cylinder head 120. When the piston 130 returns and resets, the top end of the piston 130 moves away from the cylinder head 120, and air from an external environment flows into the cylinder 110. The cylinder head 120 has an air storage chamber and an air outlet 123. After the piston 130 generates the compressed air in the cylinder 110, the compressor air is squeezed toward the air storage chamber by the piston 130 as mentioned previously and is discharged from the air compressor structure 100 through the air outlet 123 after passing through the cylinder head 120. In short, before the compressed air is discharged from the air compressor structure 100, the air storage chamber of the cylinder head 120 serves as a temporary storage area of the compressed air.

Figure 3:
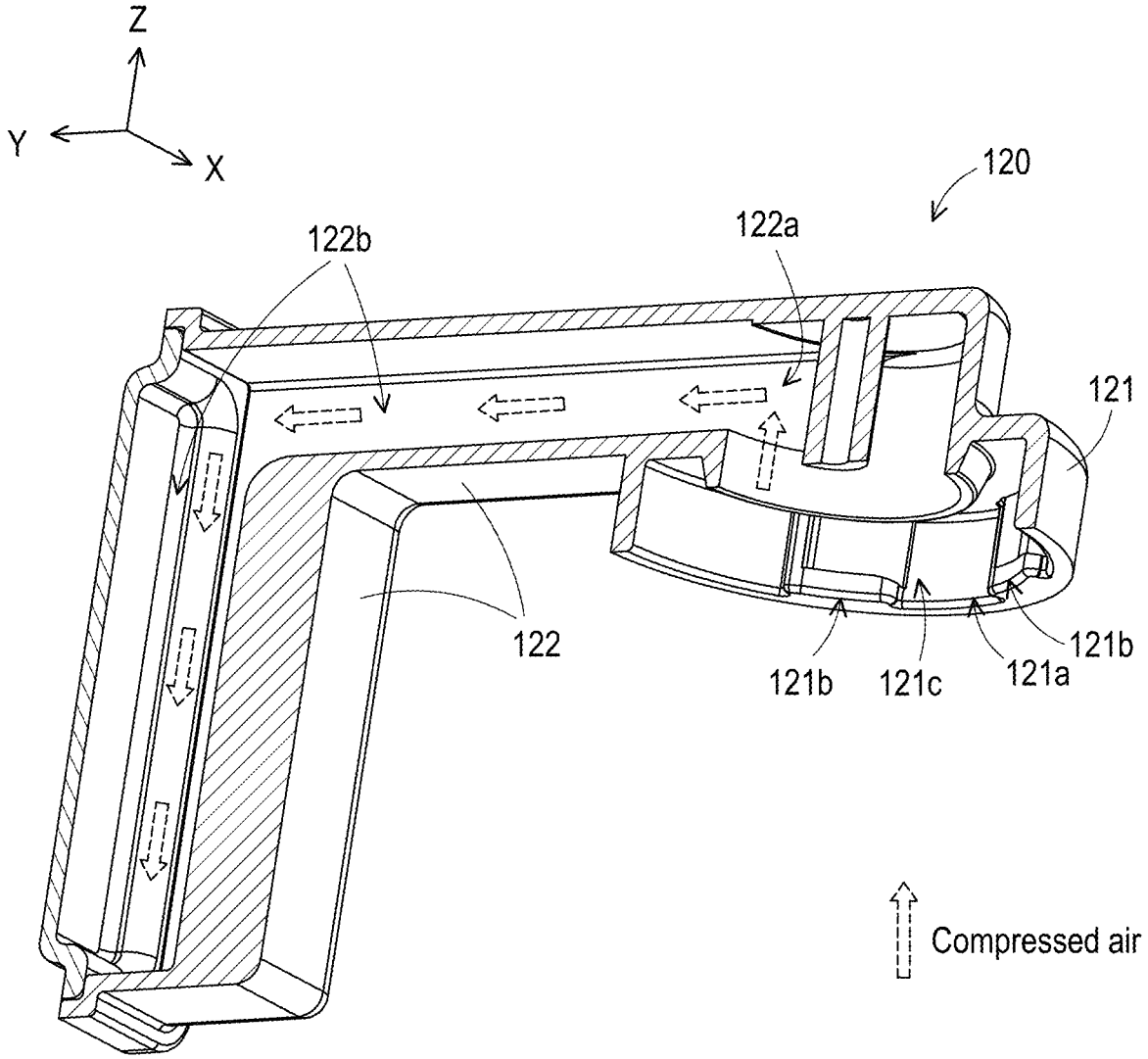
FIG. 3 and FIG. 4 are partial cross-sectional diagrams of different parts of a cylinder head.
Figure 4:
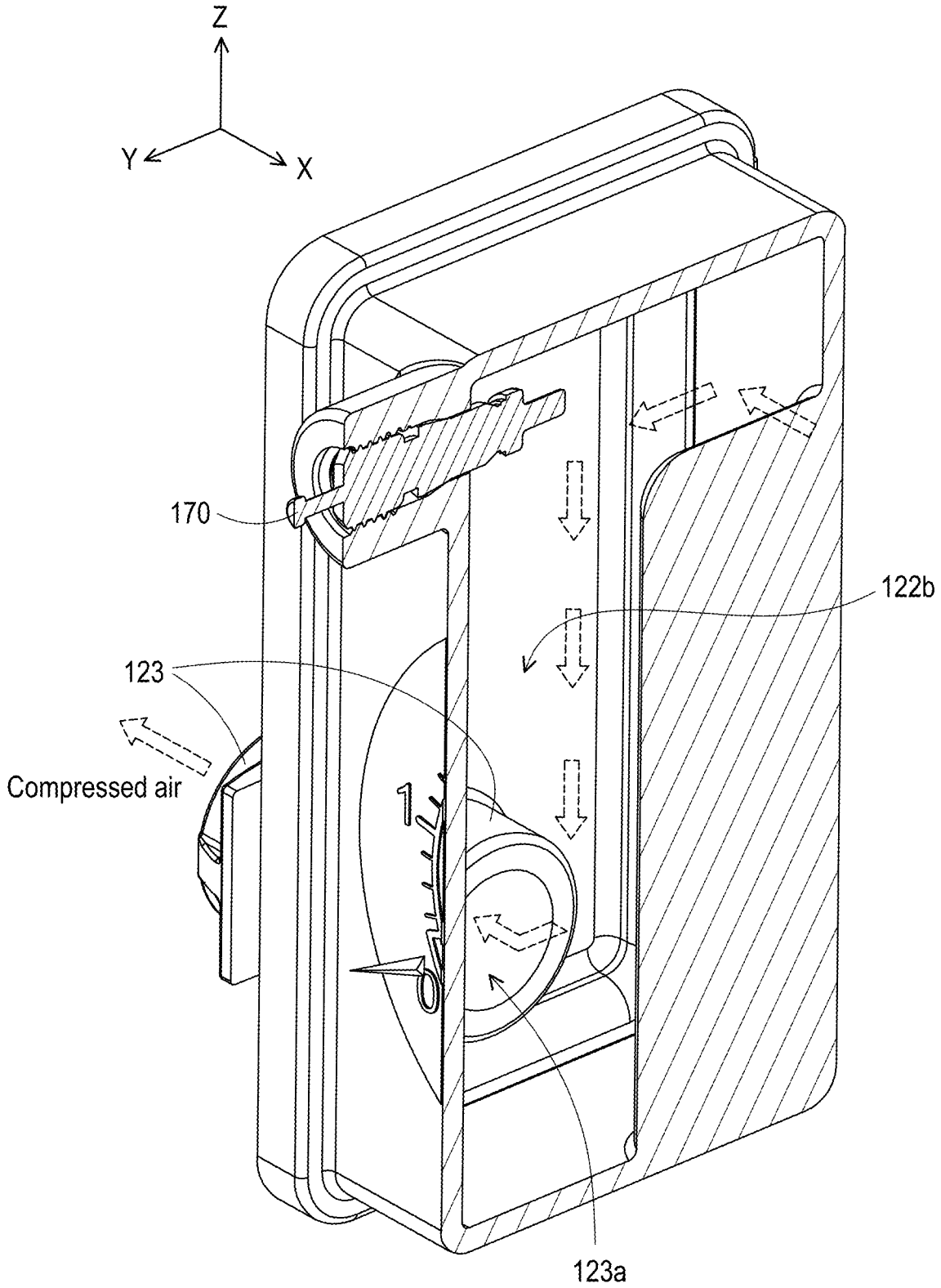

FIG. 3 and FIG. 4 are partial cross-sectional diagrams of different parts of a cylinder head. Please refer to FIG. 2 to FIG. 4 at the same time. The cylinder head 120 of this embodiment is an integrated structure composed of a cover 121 and a carrier 122. The cover 121 engages with or detaches from the cylinder 110. The carrier 122 is structurally connected to the cover 121 and has the air outlet 123. The cover 121 and the cylinder 110 are docked to receive the compressed air. Furthermore, the cover 121 has a first chamber 121*c*, and the carrier 122 has a second chamber 122*b*. The first chamber 121*c* is connected to the second chamber 122*b* through an opening 122*a*, and the opposite side of the first chamber 121*c* is communicated with the cylinder 110. The second chamber 122*b* is connected to the air outlet 123 through an opening 123*a*, so that the second chamber 122*b* may be communicated between the first chamber 121*c* and the air outlet 123. As mentioned above, after the piston 130 generates the compressed air in the cylinder 110, the compressed air is squeezed into the cylinder head 120 by the piston 130. As shown in FIG. 2, the compressed air sequentially passes through the first chamber

121*c*, the opening 122*a*, the second chamber 122*b*, and the opening 123*a*, and is discharged from the air outlet 123.

It is clear that the cylinder head 120 not only serves as a connecting component between the cylinder 110 and an object to be inflated (not shown), but also serves as a temporary storage area for the compressed air. Furthermore, the carrier 122 has an L-shaped profile, and the second chamber 122*b* has a turning point, so that residence time of the compressed air in the second chamber 122*b* may be extended accordingly. In this way, during an intermission of the reciprocating motion of the piston 130, since there is still compressed air left from the second chamber 122*b* to the first chamber 121*c*, the unstable air pressure from the intermission does not directly affect the compressed air discharged from the air outlet 123. In addition, as an operation time of the air compressor structure 100 increases or friction between the piston 130 and the cylinder 110 is experienced, the compressed air inevitably absorbs heat from the device. Since the cylinder head 120 has the first chamber 121*c* and the second chamber 122*b* (which mainly constitute the air storage chamber) for the compressed air to reside, the compressed air may dissipate heat through the structure (the carrier 122 and the cover 121) itself during the time the compressed air resides in the air storage chamber, preventing the heat of the compressed air from affecting the object to be inflated.

In addition, as shown in FIG. 1, FIG. 2, or FIG. 4, the pressure gauge 160 of the air compressor structure 100 of this embodiment is disposed in the carrier 122 to sense an air pressure of the second chamber 122*b*, and a marked scale of the pressure gauge 160 is located on a surface of the carrier 122. Accordingly, the cylinder head 120 enables a user to know the air pressure value of the air storage chamber through the built-in pressure gauge 160. In addition, the pressure relief valve 170 of this embodiment is disposed in the carrier 122 and is communicated with the second chamber 122*b*, so that the user may make a judgment after checking the pressure gauge 160 and decide whether to operate the pressure relief valve 170 accordingly to enable the pressure of the compressed air of the air storage chamber to reach a required level.

Figure 5:
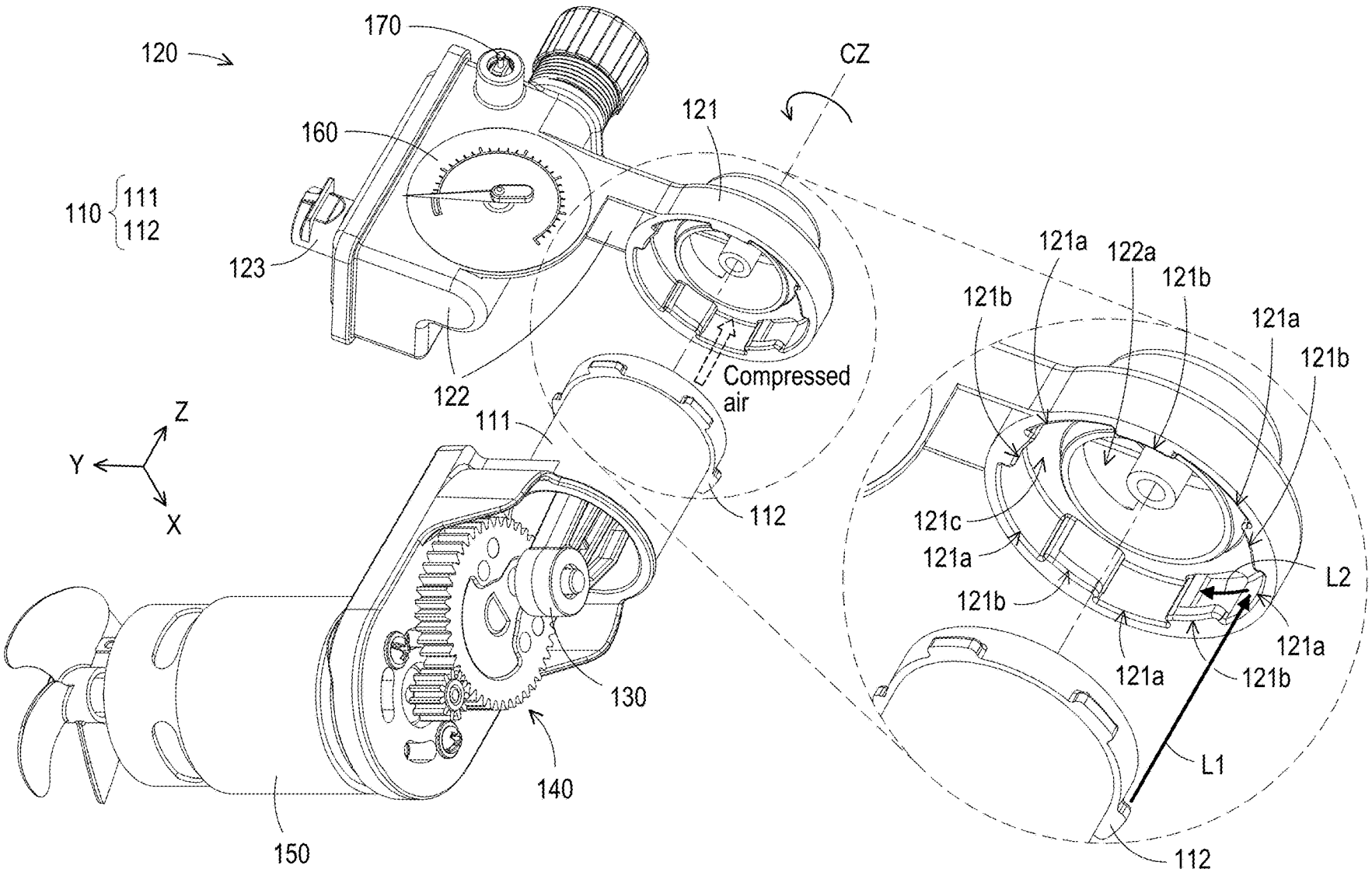
FIG. 5 is a schematic assembly diagram of a cylinder head and a cylinder.

FIG. 5 is a schematic assembly diagram of a cylinder head and a cylinder. Please refer to FIG. 2 and FIG. 5 at the same time. In this embodiment, the cover 121 and the cylinder 110 share a central axis CZ. An inner bottom edge of the cover 121 is provided with multiple notches 121*a* and multiple stoppers 121*b* that surround the central axis CZ and are staggered with each other. An outer cylindrical surface 111 of the cylinder 110 is provided with multiple protrusions 112 that are arranged around the central axis CZ and correspond to the notches 121*a* and the stoppers 121*b*. Each protrusion 112 moves into the first chamber 121*c* of the cover 121 through the corresponding notch 121*a*, and after the cover 121 and the cylinder 110 rotate relative to each other, each protrusion 112 moves into and engages with the corresponding stopper 121*b*. Here, a distance between the protrusion 112 and the central axis CZ is shorter than a distance between the notch 121*a* and the central axis CZ, and the protrusions 112 and the notches 121*a* are located on the same plane (for example, an X-Y plane) and the plane (the X-Y plane) is a normal plane of the central axis CZ (or regarded as Z axis).

In this way, during the process of assembling the cylinder head 120 and the cylinder 110, the protrusions 112 first move into the first chamber 121*c* of the cover 121 along a path L1, and the cylinder head 120 and the cylinder 110 are driven to rotate relative to each other, as shown by a spinning arrow in FIG. 5, about the central axis CZ, which is equivalent to the protrusions 112 moving along a path L2, so that the protrusions 112 engage with the stoppers 121*b* to complete the assembly. On the contrary, the user only needs to drive the cylinder head 120 and the cylinder 110 to rotate reversely around the central axis CZ along the path L2, and the cylinder head 120 and the cylinder 110 may be smoothly separated along the central axis CZ. FIG. 5 shows a state before the assembly, and FIG. 2 shows a state after the assembly.

In summary, in the air compressor structure of the embodiments of this disclosure, the cylinder head is provided with the air storage chamber and the air outlet to receive the compressed air from the cylinder and enable the compressed air to be discharged from the air outlet through a rear of the air storage chamber. In this way, the cylinder head is presented as an integrated structure, which not only engages with and covers the cylinder to receive the compressed air, but also uses the air storage chamber inside as a buffer zone for the compressed air, taking into account both structural sealing and air pressure stability to overcome impact of intermittent pressure on the structure of the pressure gauge due to the reciprocating motion of the piston accordingly. At the same time, the buffer zone allows the compressed air to dissipate heat through the peripheral structure of the buffer zone to reduce temperature rise during the air compression process.

In an embodiment, the cylinder head and the cylinder are assembled, engage with each other, or are disassembled in a rotational manner through a corresponding relationship between the protrusions, the notches, and the stoppers. In this way, a simple and practical way to combine the cylinder head and the cylinder is provided to facilitate disassembly and assembly, and enable the air compressor structure to be compact in structure as mentioned and achieve the aforementioned effects accordingly.

What is claimed is:

1. An air compressor structure, comprising:

a cylinder;

a piston, coupled into the cylinder and performing a reciprocating motion to generate compressed air; and a cylinder head, detachably assembled to the cylinder, the cylinder head having an air storage chamber and an air outlet, wherein the air storage chamber is communicated between the cylinder and the air outlet to receive the compressed air and discharge the compressed air from the air compressor structure through the air outlet, wherein the cylinder head comprises a cover and a carrier, the cover engages with the cylinder or detaches from the cylinder, the carrier is structurally connected to the cover, and the carrier has the air outlet, wherein the cover and the cylinder share a central axis, an inner bottom edge of the cover is provide with a plurality of notches and a plurality of stoppers surrounding the central axis and staggered with each other, an outer cylindrical surface of the cylinder is provided with a plurality of protrusions arranged around the central axis and correspond to the plurality of notches and the plurality of stoppers, each of the plurality of protrusions moves into the cover through the corresponding notch, and after the cover and the cylinder rotate relative to each other, each of the plurality of protrusions moves into and engages with the corresponding stopper.

2. The air compressor structure according to claim 1, wherein a distance between the protrusion and the central axis is shorter than a distance between the notch and the central axis, and the plurality of protrusions and the plurality of notches are on a same plane, the plane is a normal plane of the central axis.

3. The air compressor structure according to claim 1, wherein the cover has a first chamber, the carrier has a second chamber, the first chamber is communicated with the cylinder, and the second chamber is communicated between the first chamber and the air outlet.

4. The air compressor structure according to claim 3, wherein the carrier has an L-shaped profile, and the second chamber has a turning point.

5. The air compressor structure according to claim 3, further comprising a pressure gauge disposed in the carrier to sense an air pressure of the second chamber, wherein a marked scale of the pressure gauge is located on a surface of the carrier.

6. The air compressor structure according to claim 3, further comprising a pressure relief valve disposed in the carrier and communicated with the second chamber.

7. The air compressor structure according to claim 1, further comprising a motor and a transmission mechanism, wherein one end of the piston is coupled into the cylinder, other end of the piston is connected to the transmission mechanism, the transmission mechanism is connected to the motor, and the motor drives the piston to perform the reciprocating motion through the transmission mechanism, wherein the end of the piston moves closer to or away from the cylinder head along with the reciprocating motion.

* * * * *